United States Patent [19]

Ijichi

[11] Patent Number: 4,882,990

[45] Date of Patent: Nov. 28, 1989

[54] INK ROLLER FOR ROTARY PRESS

[75] Inventor: Yuji Ijichi, Hidaka, Japan

[73] Assignee: Rockwell International Corporation, Pittsburgh, Pa.

[21] Appl. No.: 229,385

[22] Filed: Aug. 8, 1988

[30] Foreign Application Priority Data

Aug. 18, 1987 [JP] Japan ..... 62-126228[U]
Jan. 26, 1988 [JP] Japan ..... 63-7647[U]

[51] Int. Cl.[4] ..... B41F 1/46; B21H 1/14

[52] U.S. Cl. ..... 101/348; 101/349; 29/132; 29/148.4 D

[58] Field of Search ..... 101/348–350; 29/132, 148.4 D

[56] References Cited

U.S. PATENT DOCUMENTS 3,345,942 10/1967 Meltz ..... 101/349
4,195,570 4/1980 Haren ..... 101/348

FOREIGN PATENT DOCUMENTS 187576 9/1985 Japan ..... 101/348
167092 7/1987 Japan ..... 101/348
87/06627 11/1987 PCT Int'l Appl. ..... 101/348
1463284 2/1977 United Kingdom ..... 101/348

*Primary Examiner*—Edgar S. Burr
*Assistant Examiner*—Ren Yan

[57] ABSTRACT

An ink metering roller for a keyless inking system which comprises a steel or aluminum roller core and an outer surface of highly wear-resistant hard particles imbedded in an oleophilic and hydrophobic bonding matrix, which matrix is subject to wear by contact with a coacting doctor blade, thereby creating gaps or interstices between the hard particles for conveying fixed amounts of input ink to the rotary press.

5 Claims, 2 Drawing Sheets

INK ROLLER FOR ROTARY PRESS

This invention relates to roller and doctor blade means for keyless metering of ink onto a rotary lithographic printing press.

PRIOR ART

In prior art keyless lithographic inking, the special ink metering roller used in lithographic presses has an engraved steel roller core, the surface of which may be covered with a hard coating of, for example, first copper then ceramic. The edge of a doctor blade is brought into contact with the outer surface of the ceramic coating to assure that the correct amount of ink is reserved in the recesses corresponding to the base roller engravatures.

During use of such an ink roller, the raised or land portions on the surfaces are worn by the doctor blade with the result that the volume of the recesses in the surface is decreased. This reduces the amount of ink that can be delivered by the roller and the roller's oleophilic and hydrophobic properties may be degraded, resulting in unacceptable print quality. A major disadvantage is that the worn and damaged rollers must be replaced. Replacing the roller is generally unacceptable because of the special roller's high initial cost. It was also observed that the doctor blade becomes excessively worn at the same time and does not properly remove excess ink from the roller surface.

It is therefore an object of this invention to provide an ink metering roller that allows long-term use and solves the above problems encountered when using prior art celled ink metering rollers thereby providing a more economical situation. Additionally, with the roller of this invention, the doctor blade edge becomes polished during use, rather than worn away, and does not degrade in its ability to remove excess ink from the roll surface.

Other objects and advantages of this invention will be in part obvious and in part explained by reference to the accompanying specification and drawings in which:

SPECIFICATION

Figure 1:
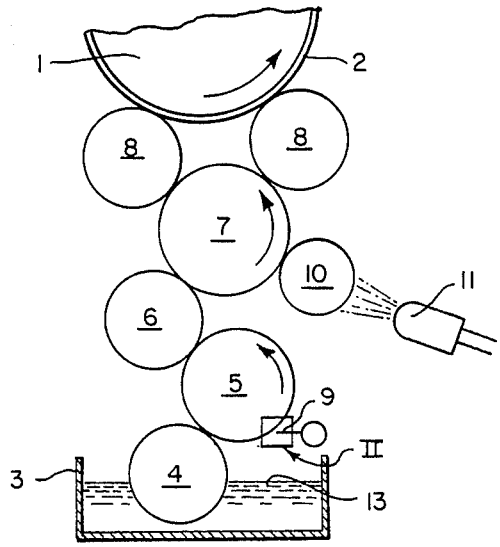
FIG. 1 is a front view illustrating the appropriate parts of a lithographic rotary press having an ink metering roller with doctor blade.

FIG. 1 illustrates the pertinent parts of a rotary printing press in which the inking roller of this invention is incorporated. In FIG. 1, numeral 1 designates a cylinder having a lithographic printing plate 2 mounted on its surface. Ink 13, contained in ink basin 3, is supplied to the lithographic plate 2 through an ink fountain rubber roller 4, an ink metering roller 5 and set of rollers 6, 7, and 8. Water is supplied simultaneously, by water supply means 11 to roller 7 by way of receiving roller 10 so that the ink rollers 7 and 8 convey water to printing plate 2 simultaneously with the ink.

Figure 2:
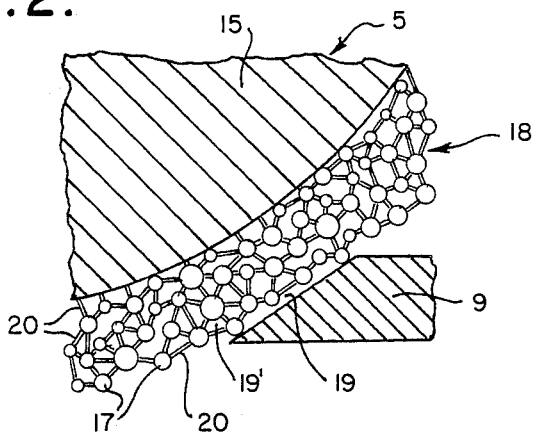
FIG. 2 is an enlarged sectional view of a portion of FIG. 1 enclosed by lines II, illustrating a fragment of an embodiment of FIG. 1.
Figure 3:
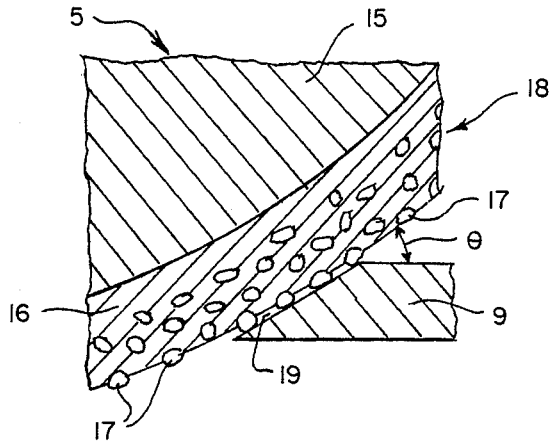
FIG. 3 is an enlarged sectional view of a portion of a type of ink roll of this invention illustrating a fragment of the roll.

To accomplish the above objective, the present invention features, as shown in FIG. 2, a composite material 18 composed of highly wear-proof hard particle 17 and a binding material or matrix 20. Binding material 20 may be a hard polymer that binds the hard particles 17 in such a way that minute gaps 19 and 19' are formed in the outer circumferential surface of metering roller 15 due to scraping contact with doctor blade 9. The ink being carried to metering roller 5 by ink fountain roller 4 penetrates into the gaps 19 and 19'. The binder material is selected from among materials that have oleophilic and hydrophobic properties.

During use of ink metering roller 5, the hard particles 17 and the binding material 20 are abraded by the action of doctor blade 9, fountain rubber roller 4, ink transfer roller 6 and pigment in the ink in such a manner that a portion of the hard particles 17 always protrudes form the nominal surface of metering roller 5. Since the binding material 20 is significantly less resistant to abrading that are the hard particles 17 it is worn away preferentially causing particles 17 to protrude from the outer surface of the material 20. The doctor blade is then in contact with the protruding hard particles, squeezing the excess ink applied by roller 4 into minute gaps 19 and 19' formed between the hard particles 17. The ink in the gaps is subsequently and sequentially transferred to the transfer roller 6, then 7, 8, and 1. During this operation the edge of the doctor blade 9 becomes ground smooth by hard particles 17.

Referring to FIG. 2, the roller core 15 in a specific example was made of steel with surface length of 1710 mm and diameter of 160 mm. Aluminum oxide was used as hard particles 17, although other oxide or carbide particles having about 20 micron average grain size can be used. Larger and smaller grain size particles are acceptable as long as the average size is about 20 microns. The hard particles 17 were mixed together with the binding material 20 to form the composite material which was then coated onto core 15. A phenol formaldehyde resin may be used as binder material 20. Alternately, oxychloride rubber or other resins may be used. Through setting or curing of the binding material 20, the coating gaps 19, 19' were formed between hard particles 17, allowing ink to penetrate through the gaps into the surface of composite material 18 as well as into the interior thereof.

I claim:

1. An ink metering roller for use in a lithographic rotary printing press in conjunction with a doctor blade that contacts the surface of the roller to remove excess ink therefrom, said roller comprising:

(a) a metal core of preselected strength and dimensions; and (b) means providing a surface on said metal core having recesses to hold ink, said means including an outer ink metering layer covering said metal core, said outer layer consisting of:

(i) a matrix material constructed of an organic substance presenting an outer surface having oleophilic and hydrophobic properties, which material is worn away during contact with the doctor blade; and (ii) a quantity of highly wear resistant particulate material dispersed throughout said matrix material, the wear of said matrix material caused by the doctor blade leaving some of said particulate matter protruding outwardly beyond the outer surface of said matrix material to define recesses holding quantities of ink and supporting the doctor blade.

2. An ink metering roller as defined in claim 1 wherein metering layers contains from 17 to about 25 percent of said particulate material by volume.

3. An ink metering roller as defined in claim 1 wherein said particulate material has an average grain size of 20 microns.

4. An ink metering roller as defined in claim 1, wherein said ink holding recesses have depths ranging from about 5 to 10 microns.

5. A process for producing an ink metering roller for use in a ligthographic rotary printing press comprising the steps of:

(a) providing a metal core of preselected strength and dimensions;

(b) coating the metal core with an organic substance containing a dispersion of from about 17 to 25 volume percent of wear resistant particulate material; and (c) removing a portion of the organic substance so that particulate material protrudes outwardly beyond the surface of the organic substance to form ink receiving recesses of from about 5 to 10 microns in depth.

* * * * *